US009194627B2

(12) United States Patent
Daley et al.

(10) Patent No.: US 9,194,627 B2
(45) Date of Patent: Nov. 24, 2015

(54) CATALYST BRICK SOLUTION SAFE HANDLING LABORATORY BENCH FIXTURE

(71) Applicants: James J Daley, Jackson, MI (US); Robert Jerger, Dexter, MI (US); Andrew Brocker, Jenison, MI (US); Wei-Jun Yang, Ann Arbor, MI (US)

(72) Inventors: James J Daley, Jackson, MI (US); Robert Jerger, Dexter, MI (US); Andrew Brocker, Jenison, MI (US); Wei-Jun Yang, Ann Arbor, MI (US)

(73) Assignee: FCA US LLC, Auburn Hills, MI (US)

( * ) Notice: Subject to any disclaimer, the term of this patent is extended or adjusted under 35 U.S.C. 154(b) by 174 days.

(21) Appl. No.: 14/132,925

(22) Filed: Dec. 18, 2013

(65) Prior Publication Data

US 2015/0168062 A1 Jun. 18, 2015

(51) Int. Cl.
*F26B 5/16* (2006.01)
*F26B 5/12* (2006.01)

(52) U.S. Cl.
CPC ..... *F26B 5/12* (2013.01)

(58) Field of Classification Search
CPC ..... F26B 5/00; F26B 5/06; F26B 5/16; F26B 25/00; F26B 25/003; F01N 3/0814; F01N 3/0842; F02D 41/0275
USPC ..... 34/406, 201, 218; 60/286, 295; 422/171
See application file for complete search history.

(56) References Cited

U.S. PATENT DOCUMENTS 2,321,015 A * 6/1943 Davis ..... 34/428
2,843,942 A * 7/1958 Whitsel, Jr. ..... 34/370
2,947,373 A 8/1960 Wilson
3,033,304 A 5/1962 Kramer
3,053,336 A 9/1962 Zednik
3,105,566 A 10/1963 Raney et al.
3,165,163 A 1/1965 Holka
3,166,385 A * 1/1965 Pahlavouni ..... 34/589
3,167,148 A 1/1965 Hinch
3,498,400 A 3/1970 Hysmith
3,821,997 A 7/1974 Sieren
3,903,981 A 9/1975 Peterson
4,013,136 A 3/1977 Fear
4,295,281 A * 10/1981 Potter ..... 34/371
4,623,366 A 11/1986 Berfield et al.
4,926,953 A 5/1990 Platt
4,936,409 A 6/1990 Nix et al.
5,192,344 A 3/1993 House
5,397,545 A * 3/1995 Balling et al. ..... 422/171
5,525,307 A * 6/1996 Yasaki et al. ..... 422/171
5,669,892 A 9/1997 Keogh et al.
5,678,564 A 10/1997 Lawrence et al.

(Continued)

FOREIGN PATENT DOCUMENTS

DE 102008050299 A1 * 4/2009 ..... F01N 11/00
EP 1114921 A2 * 7/2001 ..... F01N 11/00

(Continued)

*Primary Examiner* — Stephen M Gravini
(74) *Attorney, Agent, or Firm* — Ralph E. Smith

(57) ABSTRACT

A liquid collection device for removing a liquid from a catalyst brick is provided and includes a containment vessel having an inner volume and a receiver supported by the containment vessel and in fluid communication with the inner volume, whereby the receiver supports the catalyst brick relative to the containment vessel. The collection device further includes a vacuum source spaced apart from the receiver and in fluid communication with the inner volume. The vacuum source exerts a fluid force on the catalyst brick to draw the liquid from the catalyst brick and into the inner volume.

20 Claims, 7 Drawing Sheets

(56) References Cited

U.S. PATENT DOCUMENTS

| | | | | |
|---|---|---|---|---|
| 5,911,487 | A * | 6/1999 | Dricken | 34/92 |
| 5,953,832 | A * | 9/1999 | Rosynsky et al. | 34/403 |
| 6,102,356 | A | 8/2000 | Huntley et al. | |
| 6,192,596 | B1 * | 2/2001 | Bennett et al. | 34/76 |
| 6,593,027 | B1 | 7/2003 | Osterhart et al. | |
| 6,829,844 | B2 * | 12/2004 | Brady et al. | 34/381 |
| 7,014,002 | B2 | 3/2006 | Mizuta | |
| 7,150,933 | B1 * | 12/2006 | McLean | 429/535 |
| 7,201,572 | B2 * | 4/2007 | Wood et al. | 431/326 |
| 7,543,666 | B2 | 6/2009 | Connelly et al. | |
| 7,669,349 | B1 * | 3/2010 | Palmer et al. | 34/381 |
| 7,726,427 | B2 | 6/2010 | Picavet | |
| 8,500,706 | B2 | 8/2013 | Michaels et al. | |
| 8,567,099 | B2 * | 10/2013 | Bai et al. | 37/387 |
| 9,032,641 | B2 * | 5/2015 | Eloo et al. | 34/382 |
| 2002/0162696 | A1 | 11/2002 | Maus et al. | |
| 2010/0129606 | A1 * | 5/2010 | Rendon Granados | 428/156 |
| 2014/0178513 | A1 * | 6/2014 | Matthews | 425/6 |
| 2015/0143806 | A1 * | 5/2015 | Friesth | 60/517 |
| 2015/0168062 | A1 * | 6/2015 | Daley et al. | |

FOREIGN PATENT DOCUMENTS

| | | | | |
|---|---|---|---|---|
| EP | 2028394 | A2 * | 2/2009 | F16H 59/08 |
| GB | 912107 | A | 12/1962 | |
| GB | 2142292 | A | 1/1985 | |
| GB | 2329853 | A * | 4/1999 | B01J 37/00 |

* cited by examiner

CATALYST BRICK SOLUTION SAFE HANDLING LABORATORY BENCH FIXTURE

FIELD

The present disclosure relates to laboratory bench fixtures for the safe handling of a catalyst brick aging solution.

BACKGROUND

Exhaust from internal combustion engines ("ICEs") generally includes various combustion by-products such as $NO_x$, CO, or unburned hydrocarbons, for example. Federal and state laws generally require vehicles with ICEs to be equipped with devices to reduce tailpipe emission of these chemicals. One such device is a catalytic converter designed to convert harmful chemicals to less harmful chemicals, such as $CO_2$, $H_2O$, or $N_2$, for example. This conversion is generally achieved by forcing exhaust gasses through the catalytic converter before exiting an exhaust system of the vehicle.

Catalytic converters generally include a porous catalyst brick, which can vary in overall size, but often have 400-900 cells per inch. Each cell includes a channel that runs the entire length of the catalyst brick and receives exhaust gas during use. As the exhaust gasses flow through the cells, some of the harmful chemicals react with the catalyst brick and are converted to less harmful chemicals. Over time, the ability of the catalyst brick to react with the exhaust gasses can decrease, which leads to increased tailpipe emissions and the need to replace the catalytic converter. Thus, vehicles are generally required to be equipped with on-board diagnostic ("OBD") systems that indicate when the catalytic converter no longer performs as intended.

Vehicle manufacturers are required to test OBD systems to ensure their proper operation and to ensure proper vehicle emissions control. (For example, see: Title 13, California Code Regulations, Section 1968.2, Malfunction and Diagnostic System Requirements for 2004 and Subsequent Model-Year Passenger Cars, Light-Duty Trucks, and Medium-Duty Vehicles and Engines (OBD II)). Manufacturers test an OBD system's ability to detect that a catalytic converter has reached a particular emission level by running the OBD system with an engine having a catalytic converter with an aged catalyst brick. Some methods of aging catalyst bricks and, thus, catalytic converters for such tests, include running an ICE with the catalytic converter for a predetermined time on a vehicle or a dynamometer. Another aging process includes exposing the catalyst brick to various chemical and/or thermal conditions in a laboratory setting.

Chemical/thermal aging of a catalyst brick typically includes saturating the catalyst brick with a corrosive liquid such as an acidic solution. For example, the channels within the catalyst brick may first be completely filled with a corrosive liquid. Once the liquid has completed its purpose, the liquid is then removed from the catalyst brick prior to performing the next step in the aging process, which may include thermal exposure or further chemical exposure.

Prior methods of removing the corrosive liquid from the catalyst brick channels include manually shaking the catalyst brick over a containment vessel, and/or allowing the catalyst brick to drip-dry, i.e. air-dry, while placed over an absorbent material. Due to the many small channels of the catalyst brick, it can be difficult and time consuming to remove the corrosive aging liquid from the catalyst brick and safely store the liquid until it can be properly disposed.

SUMMARY

A liquid collection device for removing a liquid from a catalyst brick is provided and includes a containment vessel having an inner volume and a receiver supported by the containment vessel and in fluid communication with the inner volume, whereby the receiver supports the catalyst brick relative to the containment vessel. The collection device further includes a vacuum source spaced apart from the receiver and in fluid communication with the inner volume. The vacuum source exerts a fluid force on the catalyst brick to draw the liquid from the catalyst brick and into the inner volume.

A method of removing a liquid from a catalyst brick is provided and includes placing the catalyst brick in a receiver of a containment device, applying suction to a vacuum port of the containment device, allowing the suction to draw the liquid from the catalyst brick and into an inner volume of the containment device, and removing the suction from the vacuum port.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Figure 1:
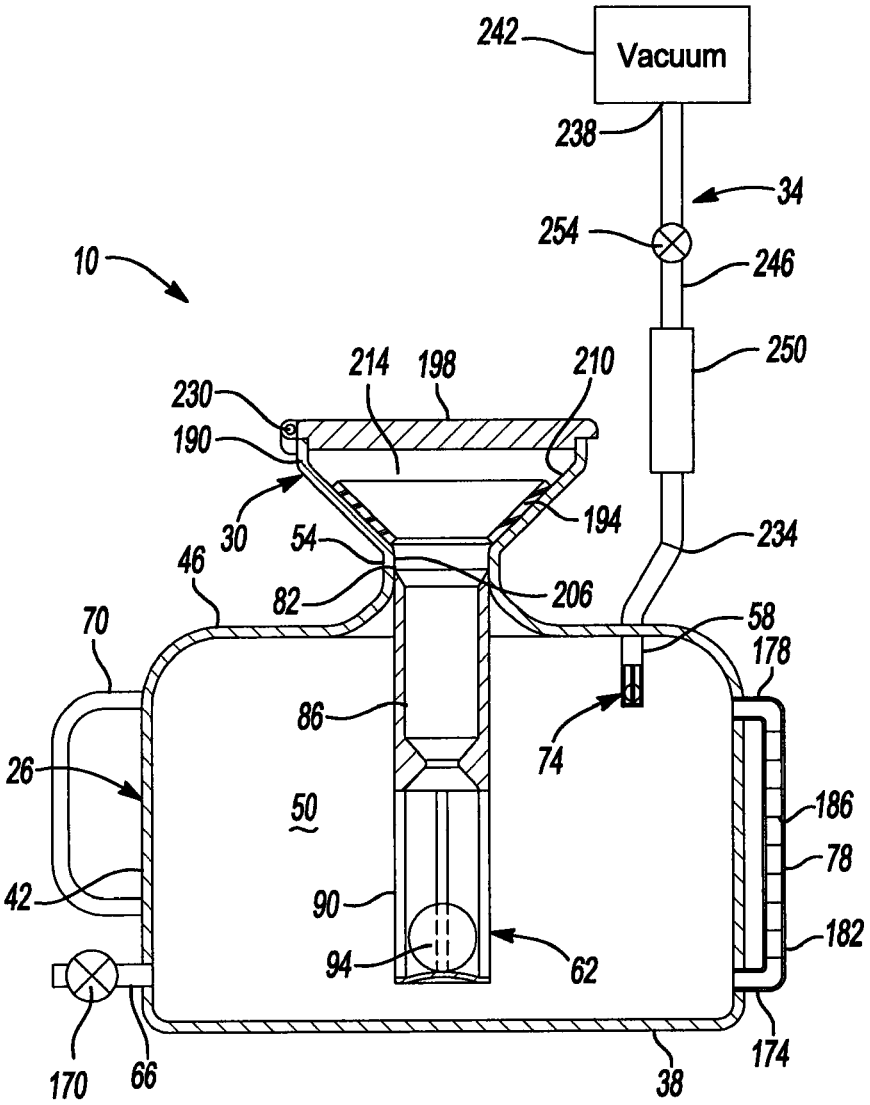
FIG. 1 is a cross-sectional view of a liquid collection device including a sealing assembly in accordance with the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an,"

and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
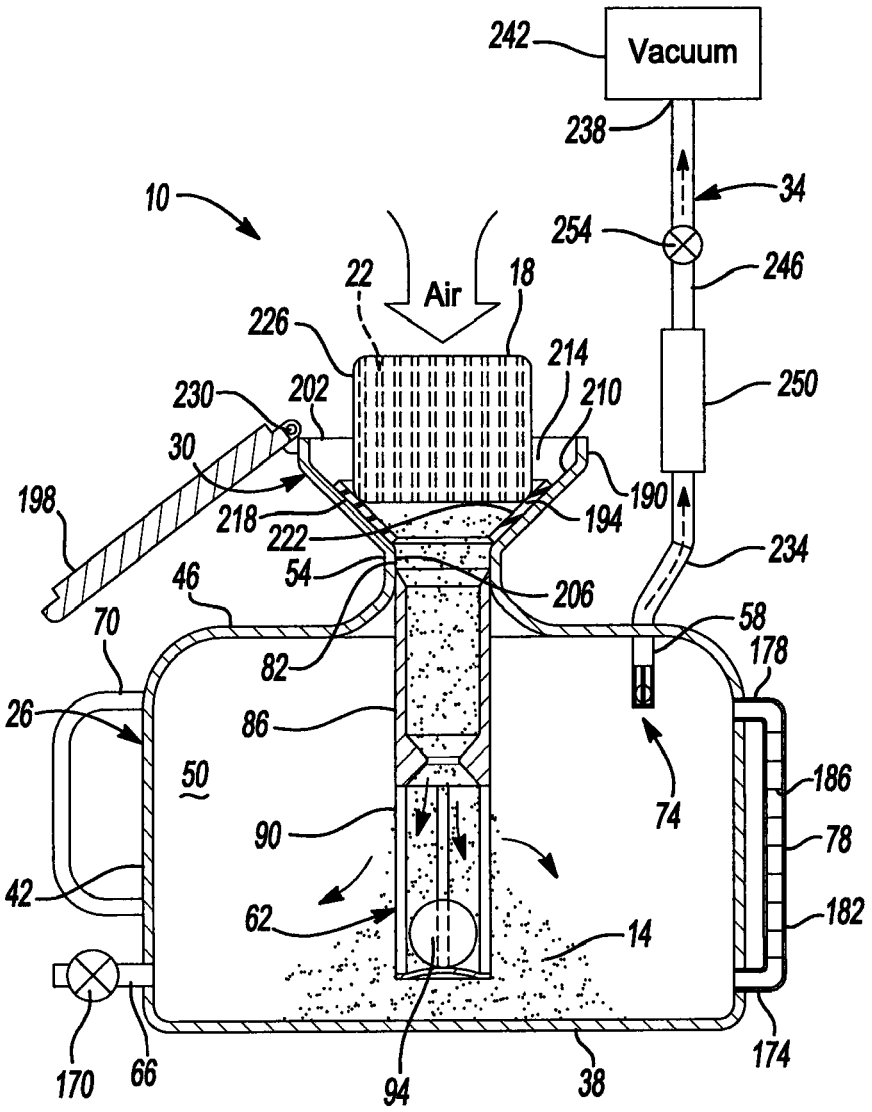
FIG. 2 is a cross-sectional view of the liquid collection device of FIG. 1 collecting liquid from a catalyst brick.
Figure 3:
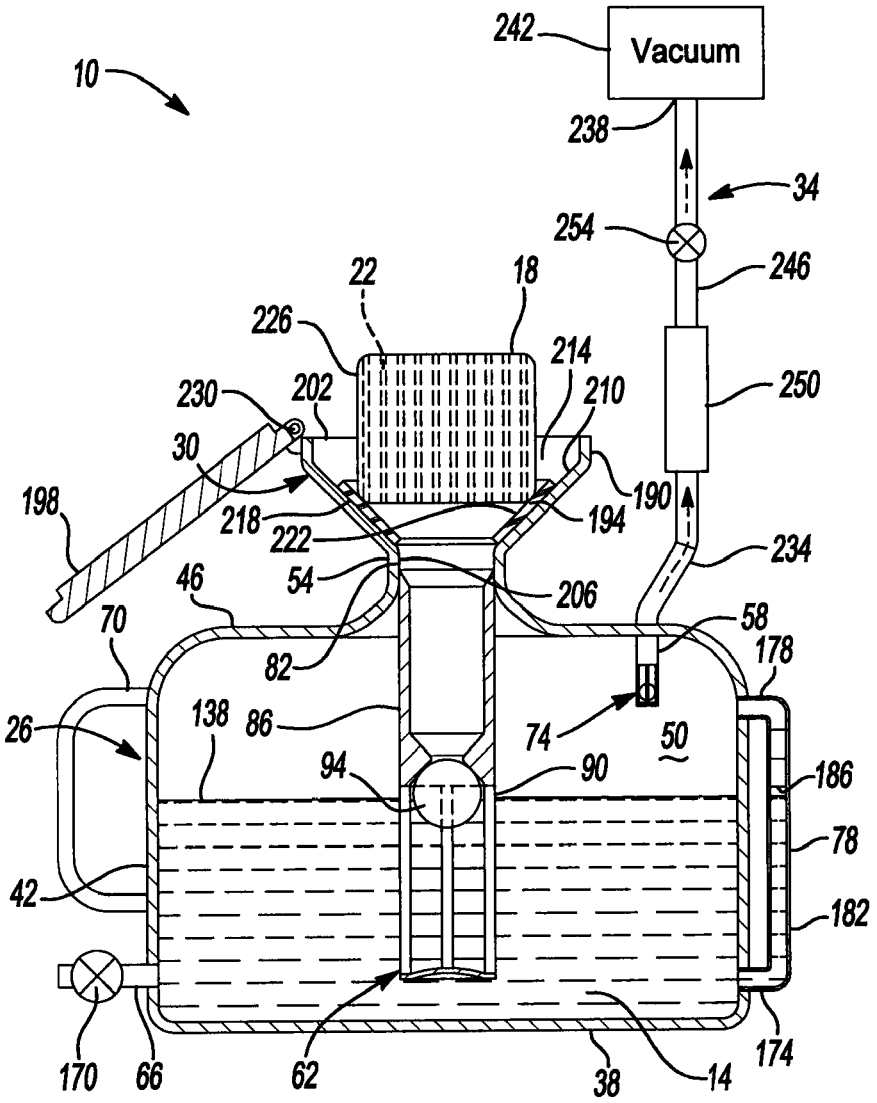
FIG. 3 is a cross-sectional view of the liquid collection device of FIG. 1 filled with liquid to a predetermined level.

FIGS. 1-3 illustrate a liquid collection device 10 for safely removing, handling, and storing an aging liquid 14 (shown in FIGS. 2 and 3) from a catalyst brick 18 of a vehicle catalytic converter (not shown). Catalyst bricks 18 generally have a plurality of small channels or pores 22 in which the liquid 14 can become entrapped during an aging process. These channels 22 are typically tightly packed and can run the length of the catalyst brick 18.

With reference to FIG. 1, the liquid collection device 10 includes a containment vessel 26, a receiver 30, and a vacuum conduit 34 that cooperate to extract the liquid 14 from the catalyst brick 18 and subsequently store the liquid 14. The containment vessel 26 includes a bottom wall 38, a side wall 42, and a top wall 46 that define a containment or inner volume 50, an inlet 54, and a vacuum port 58. The containment vessel 26 additionally includes an inlet seal assembly 62 that prevents the liquid 14 from exiting the vessel 26 at the top wall 46. The vessel 26 additionally includes a drain port 66, a handle 70, a vacuum closure member or float assembly 74, and a liquid level indicator 78. While the containment vessel 26 is illustrated as having a generally cylindrical shape, with a single cylindrical side wall 42, other geometries can be used with any number of sides. Regardless of the shape of the containment vessel 26, the vessel 26 is constructed of a material that is non-reactive with the liquid 14 to allow the vessel 26 to safely store the liquid 14 therein.

The top wall 46 defines the inlet 54, which is located between the containment volume 50 and the receiver 30, and includes an inlet orifice 82 that fluidly couples the containment volume 50 to the receiver 30. While the inlet 54 is illustrated as being centrally located in the top wall 46, other configurations can be used. Namely, the inlet 54 could be positioned at the top wall 46 but offset from a center of the top wall 46. Regardless of the position of the inlet 54, the vacuum port 58 is spaced apart from the inlet 54 and is formed through either the top wall 46 or the side wall 42 to fluidly couple the containment volume 50 with the vacuum conduit 34.

Figure 4:
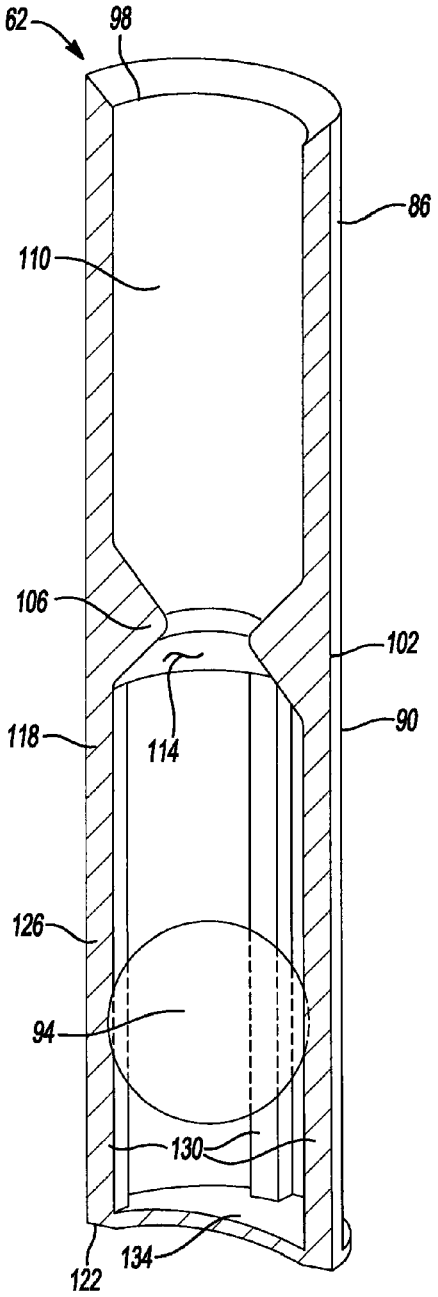
FIG. 4 is a detailed view of the sealing assembly of FIG. 1.

With reference to FIG. 4, the inlet seal assembly 62 includes an inlet conduit 86, a guide body 90, and a closure member or float 94. The inlet conduit 86 has a first end 98, a second end 102, and a sealing member 106. The first end 98 is coupled to the inlet orifice 82 and is open to the inlet orifice 82 for fluid communication with the receiver 30. The second end 102 is spaced apart from the first end 98 and is disposed within the containment volume 50 between the first end 98 of the inlet conduit 86 and the bottom wall 38 of the vessel 26. The inlet conduit 86 is a hollow, generally cylindrically shaped body, and defines a flow path 110 extending between the first end 98 and the second end 102. The second end 102 is open to the guide body 90 for fluid communication with the guide body 90. The sealing member 106 extends partially into the inlet conduit 86 and has a sealing surface 114 proximate to the second end 102.

The guide body 90 has a first end 118 and a second end 122, opposite the first end 118. The first end 118 is coupled to the second end 102 of the inlet conduit 86 and is generally open to allow fluid communication between the second end 102 and the first end 118. The guide body 90 extends from the first end 118 into the containment volume 50 and toward the bottom wall 38 of the vessel 26 to the second end 122. The guide body 90 is generally open to the containment volume 50 and includes at least one retaining member 126. In the example provided, the retaining members 126 are a plurality of bars 130 extending between the first end 118 and the second end 122, such that the guide body 90 generally forms a cage open to the containment volume 50 between the first end 118 and the second end 122. The second end 122 includes a lower retaining member 134 that retains the inlet float 94 within the guide body 90, as will be described in greater detail below.

With reference to FIGS. 3 and 4, the float 94 is disposed within the guide body 90 between the first end 118 and the second end 122. The float 94 is formed of a material and/or has a construction that causes the float 94 to be less dense than the liquid 14. Thus, buoyancy forces the float 94 to float on the liquid 14 and rise with a level 138 of the liquid 14 within the vessel 26.

The float 94 selectively forms a seal with the sealing surface 114 of the sealing member 106 depending on the liquid level 138. In the example provided, the float 94 includes a spherical shape, with the sealing surface 114 being conical. While the float 94 includes a spherical shape and the sealing surface 114 is conical, other complimentary geometries may be used for the float 94 and/or the sealing surface 114. The retaining members 126 and the lower retaining member 134 prevent the float 94 from escaping the guide body 90. The retaining members 126 additionally guide the float 94 toward the sealing surface 114 as the level 138 of the liquid 14 rises.

Figure 5:
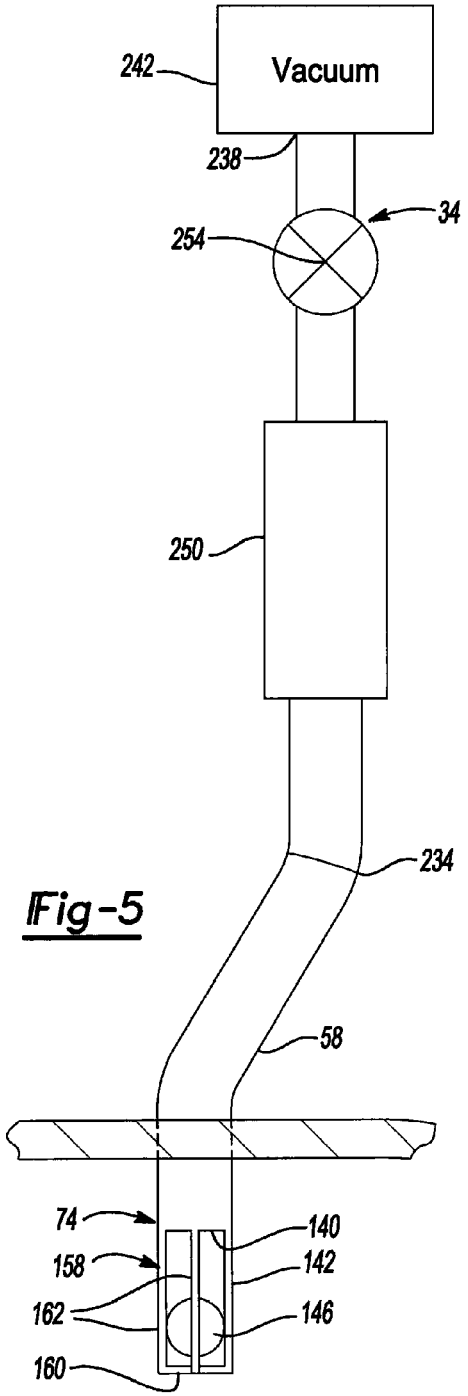
FIG. 5 is a detailed view of a vacuum float assembly of the liquid collection device of FIG. 1.

With reference to FIGS. 3 and 5, the vacuum port 58 includes an inlet port 140 located above the sealing member 106 of the inlet seal assembly 62 relative to the bottom wall 38. This configuration allows the inlet seal assembly 62 to limit additional liquid 14 from entering the containment volume 50, before the level 138 of the liquid 14 reaches the vacuum port 58. If the level 138 of the liquid 14 rises above the sealing member 106 of the inlet seal assembly 62, the vacuum float assembly 74 prevents the liquid 14 from being drawn through the inlet port 140 and into the vacuum conduit 34.

The vacuum float assembly 74 includes a guide body 142 and a float 146. The guide body 142 is generally open to the containment volume 50 and includes at least one retaining member 158 extending between the inlet port 140 and a retaining member 160. In the example provided, the retaining members 158 are a plurality of bars 162 extending along a length of the guide body 142 such that the guide body 142 generally forms a cage open to the containment volume 50. The retaining member 160 retains the float 146 within the guide body 142 and, further, directs the float 146 toward and into engagement with the inlet port 140 in response to the liquid level 138.

The float 146 is formed of a material and/or includes a construction that causes the float 146 to be less dense than the liquid 14. Thus, buoyancy forces cause the float 146 to float on the liquid 14 and rise with the level 138 of the liquid 14 within the vessel 26. The float 146 forms a seal with the vacuum port 58 if the liquid level 138 reaches a predetermined level within the vessel 26. In the example provided, the float 146 includes a spherical shape of a diameter greater than a diameter of the vacuum port 58. While the float 146 includes a spherical shape having a diameter that is greater than the diameter of the vacuum port 58, other complimentary geometries may be used for the float 146 and/or the vacuum port 58. The retaining members 158 and the lower retaining member 166 prevent the float 146 from escaping the guide body 142. The retaining members 158 additionally guide the float 146 toward the vacuum port 58 as the level 138 of the liquid 14 rises.

Returning to FIGS. 1-3, the drain port 66 extends through the containment vessel 26 into the containment volume 50 to be in fluid communication therewith. The drain port 66 may be located in the bottom wall 38 or the side wall 42 proximate to the bottom wall 38. The drain port 66 includes a closure device 170 such as a valve or plug that can be selectively opened to permit the liquid 14 to flow from the containment volume 50. The drain port 66 allows the liquid 14 to be easily and safely drained from the containment volume 50 for transport, storage, or disposal.

The handle 70 is mounted to the exterior of the containment vessel 26 to allow the containment vessel 26 to be lifted and transported. In the example provided, the containment vessel 26 includes two handles 70 although any number of handles 70 may be used.

The liquid level indicator 78 allows the level 138 of the liquid 14 within the vessel 26 to be easily ascertained without removing the catalyst brick 18. In the example provided, the liquid level indicator 78 is a sight-glass type indicator with a first indicator port 174 located proximate to the bottom wall 38 and a second indicator port 178 spaced apart from the first indicator port 174 and located proximate to the top wall 46. The first and second indicator ports 174, 178 extend through the side wall 42 for fluid communication with the containment volume 50 and are fluidly coupled by a transparent or translucent sight-glass 182 located externally of the containment volume 50.

In operation, as the liquid level 138 rises within the containment volume 50, the liquid 14 passes through the first indicator port 174 and the level 138 can be seen in the sight-glass 182. The sight-glass 182 can also include indicator marks 186 for determining the volume of the liquid 14 or the remaining capacity of the containment volume 50. While the example provided includes a sight-glass type liquid level indicator 78, other indicators may be used such as a transparent or translucent material forming at least a portion of the side wall 42 for visually seeing into the containment volume 50.

The receiver 30 includes a receiver body 190, a seal 194, and a lid 198. The receiver body 190 defines an opening 202, an outlet 206 opposite the opening 202, and has an interior surface 210 extending between the first and second orifices 202, 206 to define a receiving volume 214. The opening 202 is of a larger diameter or area than the outlet 206 and accepts the catalyst brick 18 when the catalyst brick 18 is inserted into the receiving volume 214. The outlet 206 has a smaller diameter than the catalyst brick 18 to prevent the catalyst brick 18 from entering the inlet 54 when the catalyst brick 18 is disposed within the receiving volume 214. The receiver body 190 is coupled to the inlet 54 of the containment vessel 26 and the outlet 206 fluidly couples the receiving volume 214 to the inlet 54 of the containment vessel 26 and to the inlet conduit 86 of the inlet seal assembly 62.

The seal 194 is disposed within the receiving volume 214 and has an exterior sealing surface 218 that forms a seal with the interior surface 210 of the receiver body 190 and an interior sealing surface 222 that forms a seal with catalyst bricks 18 of various sizes. In the example provided, the interior sealing surface 222 includes a conical shape such that catalyst bricks 18 of various diameters can form a seal between an outer circumferential surface 226 of the catalyst brick 18 and the interior sealing surface 222 of the seal 194. For example, a catalyst brick 18 having a smaller diameter would engage the seal 194 at the interior sealing surface 222 at a location that is closer to the outlet 206 when compared to a catalyst brick 18 having a larger diameter. In the example provided, the receiver body 190 includes a generally conical shape that matingly receives the generally conical shape of the seal 194. While the catalyst brick 18 is shown and described as including a generally cylindrical shape, the catalyst brick 18 could include a different cross-sectional shape such as, for example, an elliptically shaped cross-sectional area. Accordingly, the interior sealing surface 222, and/or the receiver body 190, can be shaped to accommodate other catalyst bricks having such cross-sectional shapes. For example, the interior sealing surface 222, and/or the receiver body 190, can be an elliptical cone shape to accommodate a catalyst brick 18 with an elliptically shaped cross-sectional area.

The lid 198 is attached to the receiver body 190 and is movable between an open position (FIGS. 2 and 3) and a closed position (FIG. 1). The lid 198 is illustrated as being coupled to the receiver body 190 by a hinge 230 such that the lid 198 pivots about the hinge 230 when moved between the open and closed positions. In the closed position, the lid 198 caps the opening 202 of the receiver body 190 and forms a seal with the receiver body 190 to prevent the liquid 14 from escaping the containment vessel 26 through the receiver 30. In the open position, the receiver body 190 is free to receive the catalyst brick 18 through the opening 202.

The vacuum conduit 34 includes an end 234 that is fluidly coupled to the vacuum port 58 and an end 238 that is fluidly coupled to a vacuum source 242. The vacuum source 242 can be any type of external vacuum source such as a vacuum pump or a centralized vacuum system, for example, that draws air from the containment volume 50 through the vacuum port 58. The vacuum conduit 34 includes a flexible tube 246 that is resistant to collapse when the vacuum source 242 applies suction to the vacuum conduit 34. The vacuum conduit 34 optionally includes a separator 250, such as a vapor and/or liquid separator that is disposed in-line with the tube 246.

The separator 250 separates vapor and/or liquid phases of the liquid 14 from air drawn through the containment vessel 26. The separator 250 can absorb or collect the liquid 14 to separate the liquid 14 from the air. Alternatively, the separator 250 can divert the liquid 14 to a second tube (not shown), which can return the liquid 14 to the containment volume 50 or to a secondary containment storage device (not shown). The vacuum conduit 34 may additionally include a valve 254 in-line with the tube 246. The valve 254 is movable between an open position and a closed position. In the open position, the valve 254 allows the vacuum source 242 to draw air from the containment volume 50. In the closed position, the valve 254 isolates the containment volume 50 from the vacuum source 242 to prevent fluid communication from the containment volume 50 through the valve 254. While the valve 254 is illustrated down-stream of the separator 250, the valve 254 could alternatively be located between the vacuum port 58 and the separator 250. Further, the vacuum conduit 34 may be configured so as not to include one or both of the separator 250 and the valve 254.

Figure 6:
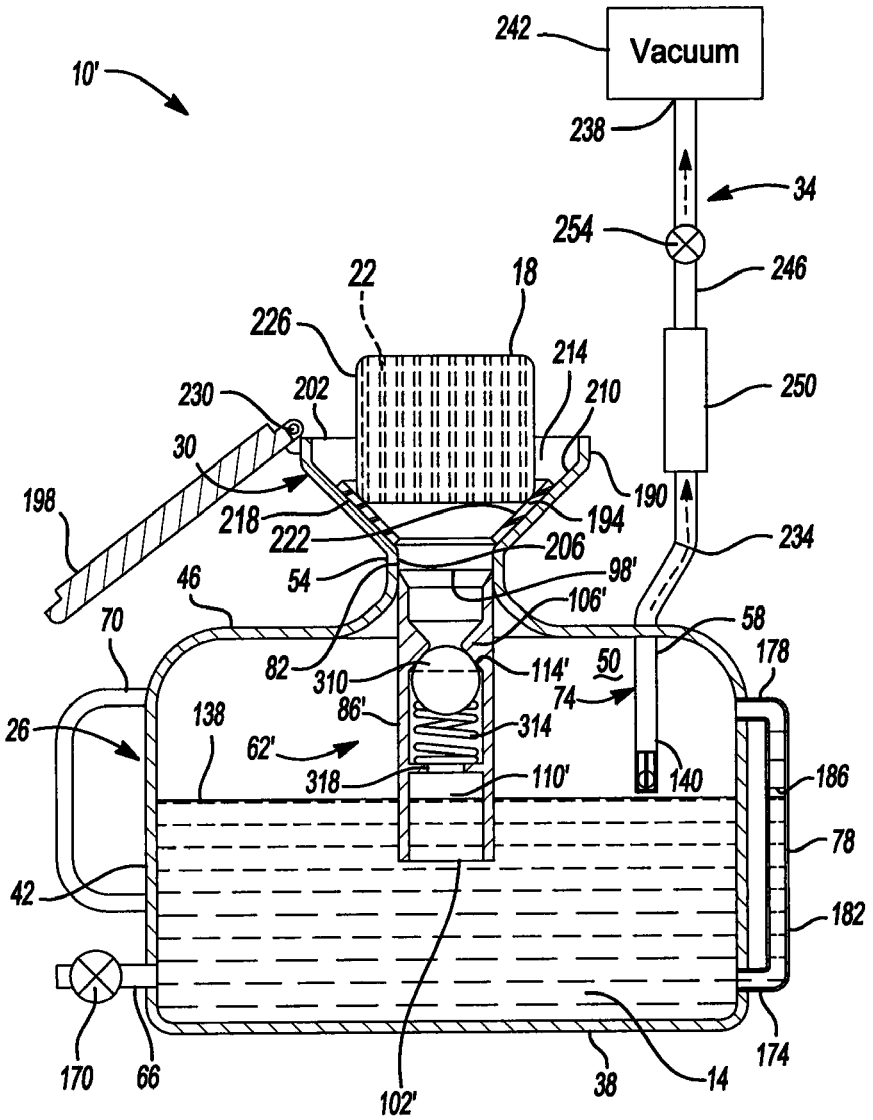
FIG. 6 is a cross-sectional view of a liquid collection device including a sealing assembly in accordance with the present disclosure.

With reference to FIG. 6, a liquid collection device 10' is provided and includes an inlet seal assembly 62'. In view of the substantial similarity in structure and function of the components associated with the liquid collection device 10 with respect to the liquid collection device 10', like reference numerals are used hereinafter and in the drawings to identify like components while like reference numerals containing a (') are used to identify those components that have been modified.

The inlet seal assembly 62' includes an inlet conduit 86', an inlet sealing body 310, and a biasing member 314. The inlet conduit 86' has a first end 98', a second end 102', a sealing member 106', and a support member 318. The first end 98' is coupled to the inlet orifice 82 and is open to the inlet orifice 82 for fluid communication with the receiver 30. The second end 102' is spaced apart from the first end 98' and is disposed within the containment volume 50 between the first end 98' and the bottom wall 38. The inlet conduit 86' is a hollow, generally cylindrically shaped body, and defines a flow path 110' extending between the first end 98' and the second end 102'. The second end 102' is open to the containment volume 50 for fluid communication with the containment volume 50.

The sealing member 106' extends partially into the inlet conduit 86' and has a sealing surface 114' proximate to the second end 102'. The inlet sealing body 310 and biasing member 314 are disposed within the flow path 110' between the support member 318 and the sealing member 106'.

The support member 318 extends partially into the inlet conduit 86' and can be a ridge or platform, for example, upon which the biasing member 314 is supported between the second end 102' and the sealing member 106'. The biasing member 314 biases the sealing body 310 toward the sealing member 106' and into sealing contact with sealing surface 114'. The biasing member 314 provides a predetermined biasing force that can be overcome by the suction provided by vacuum source 242. Thus, when vacuum source 242 provides suction to the vacuum port 58, the biasing force is overcome and the inlet sealing body 310 is moved out of sealing contact with sealing surface 114' to allow liquid 14 to enter the containment volume 50 through the inlet conduit 86'. When the sealing body 310 is in sealing contact with sealing surface 114', liquid 14 is prevented from entering and exiting the containment volume 50. Thus, when the suction from the vacuum source 242 is shut off or blocked from acting on the containment volume 50, the biasing member 314 holds the inlet sealing body 310 in sealing contact with sealing surface 114' to prevent entry of liquid 14 into the containment volume 50 at the sealing member 106'.

In this configuration, the inlet port 140 of the vacuum port 58 extends below the inlet sealing member 106'. As the level 138 of the liquid 14 rises in the containment volume 50, the float assembly 74 will close to prevent the liquid 14 from being drawn through the vacuum port 58 before the level 138 rises above the inlet sealing member 106'. The closing of the vacuum float assembly 74 blocks suction from being applied to the containment volume 50 and, thus, allows the biasing member 314 to move the inlet sealing body 310 into sealing contact with the sealing surface 114'.

Figure 7:
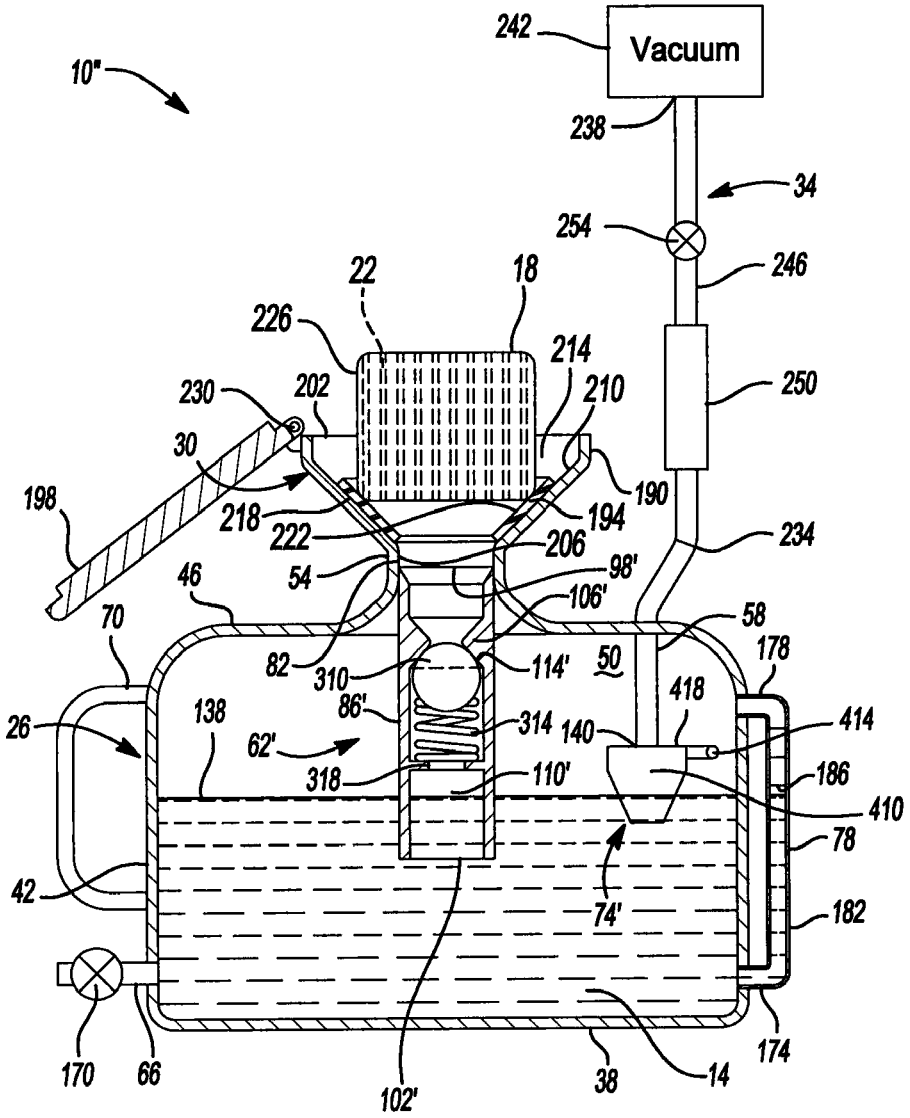
FIG. 7 is a cross-sectional view of the liquid collection device of FIG. 6 including a vacuum float assembly.

With reference to FIG. 7, a liquid collection device 10" is provided and includes a vacuum float assembly 74. In view of the substantial similarity in structure and function of the components associated with the liquid collection device 10 with respect to the liquid collection device 10", like reference numerals are used hereinafter and in the drawings to identify like components while like reference numerals containing a (') are used to identify those components that have been modified. While the vacuum float assembly 74' will be described and shown in conjunction with the configuration shown in FIG. 7, the vacuum float assembly 74' could be used in conjunction with either of the devices 10, 10' shown in FIGS. 1 and 6, respectively.

The vacuum float assembly 74' is configured to prevent the liquid 14 from being drawn through the vacuum port 58 and into the vacuum conduit 34. The vacuum float assembly 74' includes a float 410 and a hinge 414, whereby the float 410 is pivotably coupled to the hinge 414. The float 410 is formed of a material and/or includes a construction that causes the float 410 to be less dense than the liquid 14. Thus, buoyancy forces cause the float 410 to float on the liquid 14 and pivot about the hinge 414 to rise with the level 138 of the liquid 14.

The float 410 has a vacuum sealing surface 418 that closes or forms a seal with the inlet port 140 of the vacuum port 58 when the level 138 reaches a predetermined height. As the level 138 of the liquid 14 rises in the containment volume 50, the vacuum float assembly 74' will close to prevent the liquid 14 from being drawn through the vacuum port 58 before the level 138 rises above the inlet sealing member 106'. The closing of the vacuum float assembly 74' blocks suction from being applied to the containment volume 50 and, thus, allows the biasing member 314 to move the inlet sealing body 310 into sealing contact with the sealing surface 114'.

Figure 8:
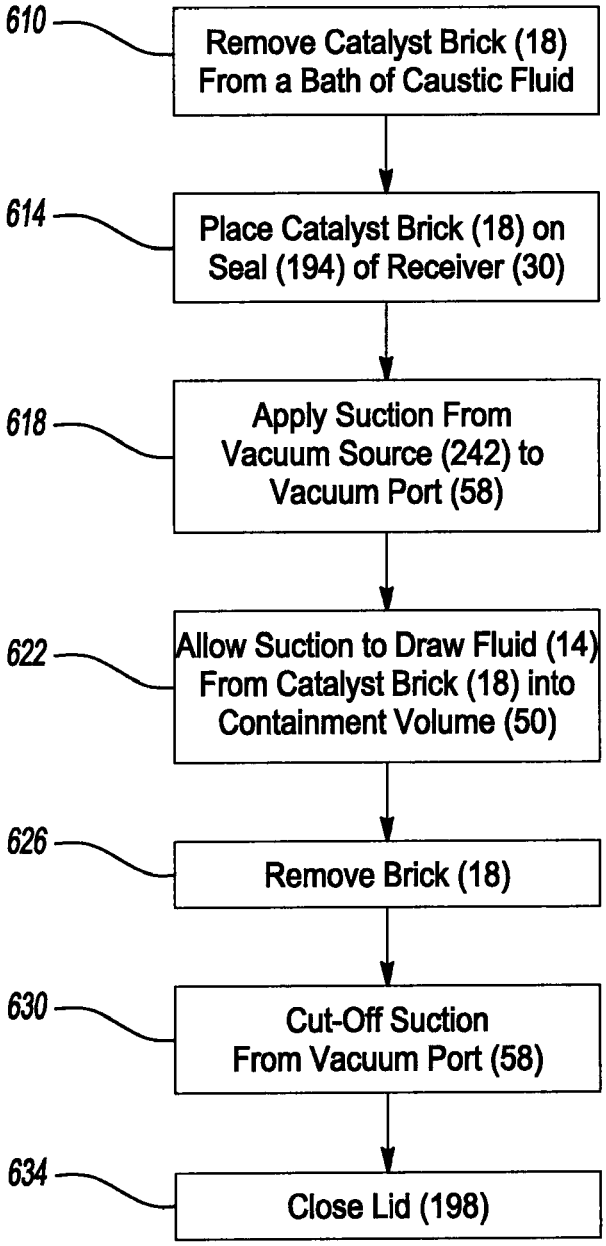
FIG. 8 is a flow chart of a method for removing and storing a corrosive liquid from a catalyst brick.

With reference to FIG. 8, operation of the collection device 10 will now be described. As described above, the catalyst brick 18 can become saturated with the corrosive liquid 14 during a chemical aging process and the liquid 14 must be removed from the catalyst brick 18 before proceeding to the next step in the aging process or using the catalyst brick 18 for OBD testing. Accordingly, in step 610, the catalyst brick 18 is removed from a bath of corrosive liquid 14. At this point, the channels 22 of the catalyst brick 18 are substantially saturated with and contain the liquid 14. In step 614, the saturated catalyst brick 18 is placed through the opening 202 of the receiver 30 and is seated on the interior sealing surface 222 of the seal 194. The outer circumferential surface 226 of the catalyst brick 18 seals with the interior sealing surface 222 of the seal 194 to restrict fluid flow around the catalyst brick 18 and between surfaces 222, 226.

In step 618, a vacuum is applied from the vacuum source 242 to the vacuum port 58. Because the vacuum port 58 is in fluid communication with the inlet 54 and the outer circumferential surface 226 of the catalyst brick 18 is sealed with the seal 194, air is drawn through the channels 22 of the catalyst brick 18. The suction forces liquid 14 entrapped in the channels 22 to pass through the inlet 54 and through the inlet conduit 86 and into the containment volume 50, where it is collected. Thus, in step 622 the suction draws the corrosive liquid 14 from the catalyst brick 18, into the containment volume 50. Once all or a desired amount of the liquid 14 is removed from the catalyst brick 18, the catalyst brick 18 is removed from the receiver 30 in accordance with step 626.

In step 630, the suction applied to the vacuum port 58 can be shut off. The suction can be shut off by closing valve 254, shutting off the vacuum source 242, or removing the vacuum source 242 from the vacuum conduit 34. Additionally, in step 634, the lid 198 can be closed to prevent liquid 14 from escaping through the receiver 30. The lid 198 can also be closed prior to shutting off the suction, in order to provide a slight vacuum, or negative pressure within the containment volume 50 to further seal the lid 198.

If during removal of the liquid 14 from the catalyst brick 18, the level of the liquid 14 disposed within the containment volume 50 causes the float 94 to engage the sealing member 106, additional liquid 14 from the catalyst brick 18 or otherwise is prevented from entering the containment volume 15 due to engagement of the float 94 and the sealing member 106. Because the sealing member 106 is disposed closer to the bottom wall 38 of the vessel 26 than the vacuum float assembly 74, liquid is never drawn by the vacuum source 242. Should the float 94 somehow fail to prevent entry of liquid 14 at the sealing member 106, however, the liquid 14 is not drawn into the vacuum source 242 due to engagement between the float 146 and the inlet port 140 of the vacuum port 58. In short, the floats 94, 146 cooperate with the incoming liquid 14 to allow the device 10 to extract liquid 14 from the catalyst brick 18 but restrict the volume of liquid 14 that is permitted to enter the containment volume 50.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A liquid collection device for removing a liquid from a catalyst brick, the liquid collection device comprising:

a containment vessel having an inner volume;

a receiver supported by said containment vessel and in fluid communication with said inner volume, said receiver operable to support the catalyst brick relative to said containment vessel; and a vacuum source spaced apart from said receiver and in fluid communication with said inner volume, said vacuum source operable to exert a fluid force on the catalyst brick to draw the liquid from the catalyst brick and into said inner volume.

2. The liquid collection device of claim 1, wherein said receiver includes a seal operable to form a seal between the catalyst brick and said receiver when the catalyst brick is supported by said receiver.

3. The liquid collection device of claim 2, wherein said receiver includes a conical shape extending from an inlet of said receiver to a junction of said receiver and said containment vessel, said seal covering at least a portion of said conical shape.

4. The containment device of claim 1, further comprising an inlet sealing assembly disposed within said inner volume and operable in a first state permitting entry of the liquid into said inner volume and in a second state preventing entry of the liquid into said inner volume.

5. The containment device of claim 4, wherein said inlet sealing assembly is moved from said first state to said second state in response to a liquid level within said inner volume.

6. The containment device of claim 4, wherein said inlet seal assembly includes a closure member and a guide body, said closure member operable to engage a sealing surface of said guide body when said inlet sealing assembly is in said second state.

7. The containment device of claim 6, wherein said closure member is a float that is responsive to a liquid level within said inner volume, said float engaging said sealing surface to move said inlet seal assembly from said first state to said second state when a predetermined volume of the liquid is disposed within said inner volume.

8. The containment device of claim 1, wherein said vacuum source is fluidly coupled to said inner volume by a conduit.

9. The containment device of claim 7, further comprising a second closure member associated with said conduit and operable in a first state permitting said vacuum source to exert said fluid force on the catalyst brick and operable in a second state preventing said vacuum source from exerting said fluid force on the catalyst brick.

10. The containment device of claim 9, wherein said second closure member is a float responsive to a liquid level within said inner volume, said float moving from said first state to said second state in response to a predetermined volume of liquid being disposed within said inner volume.

11. The containment device of claim 1, further comprising a float disposed within said inner volume and responsive to a liquid level within said inner volume.

12. The containment device of claim 11, wherein said float prevents entry of the liquid into said inner volume from said receiver when a predetermined amount of the liquid is disposed within said inner volume.

13. The containment device of claim 12, wherein said containment vessel includes an inlet disposed proximate to a junction of said receiver and said containment vessel, said float operable to selectively seal said inlet when said predetermined amount of liquid is disposed within said inner volume.

14. The containment device of claim 12, wherein said containment vessel includes an inlet associated with said vacuum source, said float operable to selectively seal said inlet when said predetermined amount of liquid is disposed within said inner volume.

15. A method of removing a liquid from a catalyst brick comprising:

placing the catalyst brick in a receiver of a containment device;

applying suction to a vacuum port of said containment device;

allowing said suction to draw the liquid from the catalyst brick and into an inner volume of said containment device; and removing said suction from said vacuum port.

16. The method of claim 15, wherein placing the catalyst brick in said receiver includes moving the catalyst brick along a conical surface of the receiver until a junction between the catalyst brick and said receiver is sealed around the perimeter of the catalyst brick.

17. The method of claim 16, wherein moving the catalyst brick along said conical surface includes moving the catalyst brick along a seal of said receiver.

18. The method of claim 15, further comprising preventing entry of the liquid into said inner volume when a predetermined amount of the liquid is disposed within said inner volume.

19. The method of claim 18, wherein preventing entry of the liquid into said inner volume includes engaging a closure member with an inlet to said inner volume.

20. The method of claim 19, wherein engaging said closure member with said inlet includes floating said closure member on the liquid within said inner volume to cause said closure member to engage said inlet.

* * * * *